US007811022B2

(12) United States Patent
Bobrosky et al.

(10) Patent No.: US 7,811,022 B2
(45) Date of Patent: Oct. 12, 2010

(54) FLEXIBLE FLOOR CLEANING DEVICE

(75) Inventors: Vincent Bobrosky, Normal, IL (US); Scott Bolbock, Normal, IL (US); Jeffrey M. Gesiakowski, Bloomington, IL (US); Richard Herrmann, Bloomington, IL (US); Sam Hohulin, Lexington, IL (US); Darin Rhoda, Bloomington, IL (US)

(73) Assignee: Electrolux Home Care Products, Inc.

( * ) Notice: Subject to any disclaimer, the term of this patent is extended or adjusted under 35 U.S.C. 154(b) by 1130 days.

(21) Appl. No.: 11/476,617

(22) Filed: Jun. 29, 2006

(65) Prior Publication Data

US 2007/0020020 A1 Jan. 25, 2007

Related U.S. Application Data

(60) Provisional application No. 60/694,707, filed on Jun. 29, 2005.

(51) Int. Cl.
*A46B 11/04* (2006.01)

(52) U.S. Cl. ..... 401/270; 401/9; 401/266; 15/228; 15/209.1

(58) Field of Classification Search ..... 401/268, 401/270, 9, 10, 11, 261, 265, 266, 290; 15/209.1, 15/210.1, 228, 244.3, 247, 321, 322
See application file for complete search history.

(56) References Cited

U.S. PATENT DOCUMENTS 3,355,762 A * 12/1967 Cavell et al. ..... 15/321
5,887,313 A 3/1999 Hanold et al.
6,370,731 B1 * 4/2002 Carter ..... 15/393
6,651,290 B2 11/2003 Kingry et al.
6,775,874 B2 * 8/2004 Horton ..... 15/165
6,981,291 B2 1/2006 McKay
7,059,011 B2 6/2006 Capitani
7,065,825 B2 6/2006 Minkler et al.
7,210,185 B2 * 5/2007 Paas ..... 15/49.1
2004/0107522 A1 6/2004 Paas
2004/0177863 A1 9/2004 McKay
2006/0168748 A1 8/2006 Dotterman et al.
2006/0168750 A1 8/2006 Dotterman et al.

* cited by examiner

*Primary Examiner*—David J Walczak
(74) *Attorney, Agent, or Firm*—Hunton & Williams

(57) ABSTRACT

A flexible cleaning device with a handle having a first end and a second end, a malleable head at the first end of the handle, a cover selectively covering at least a portion of the malleable head, and a grip at the second end of the handle. A fluid reservoir may be supported on the handle or the malleable head, and a fluid deposition system provided and adapted to selectively deposit fluid from the reservoir onto a surface to be cleaned. The malleable head may be attached to a rigid structure at the second end of the handle, and have a non-absorbent flexible structure adapted to conform to grout lines in a typical tiled floor surface. An air inlet may be attached to the device, and an air passage provided and adapted to connect the air inlet to a suction source.

23 Claims, 7 Drawing Sheets

FLEXIBLE FLOOR CLEANING DEVICE

CLAIM OF PRIORITY

This patent claims priority to U.S. Provisional Application No. 60/694,707, filed on Jun. 29, 2005, which is incorporated herein by reference in its entirety.

FIELD OF THE INVENTION

The present invention relates generally to floor cleaning devices, and more particularly to devices having a cleaning head comprising a malleable cleaning structure.

BACKGROUND OF THE INVENTION

In the art of maintaining a clean and sanitized living environment, it has been found that certain surfaces benefit from specialized cleaning treatment. For example, hard surfaces, such as tile, linoleum and wood floors, often become contaminated by fluids, which in turn attract dust and debris that adheres to the fluid. In this situation, it may be desirable to apply a cleaning fluid or steam that breaks down the contaminating fluid's grip on the floor. In other cases, dirt and debris simply rests on the hard surface without being adhered thereto, in which case it may be desirable to remove the dirt and debris by using a wet cleaning surface to which the dirt will adhere. In either event, cleaning may be advanced by scrubbing the surface under pressure.

Traditionally, hard surfaces are cleaned using mops or sponges. Using these devices, the mop or sponge is repeatedly soaked in the cleaning fluid (such as water with a chemical disinfectant), applied to the surface, then re-soaked in the fluid to remove the dirt. One significant disadvantage of this operation is the requirement of maintaining a separate container of cleaning fluid. Furthermore, the cleaning fluid becomes more and more contaminated as the mop or sponge is re-soaked, which reduces the effectiveness of the cleaning operation.

Various cleaning devices have been proposed and introduced to make hard surface cleaning easier and more effective. One such system simply comprises a wand with a planar, rectangular cleaning head to which disposable cleaning cloths can be applied. The cleaning cloths may be dry, given electrostatic properties, or imbued with cleaning chemicals. The cleaning head in such devices comprises a generally flat working surface made of plastic or relatively rigid flexible rubber or synthetic material. A typical device of this nature is illustrated in U.S. Pat. No. 6,651,290, which is incorporated herein by reference. Other hard surface cleaners also include a source of steam or heated liquid, such as the devices represented by the "STEAM MOP" available from Bissell Homecare, Inc. of Grand Rapids, Mich.; the "DSS50 STEAM MOP" available from Delonghi America of Saddle Brook, N.J.; and the "ENVIRO-STEAMER" available from The Eureka Company of Bloomington, Ill. One variation of these steam mops includes a vacuum that works with the cleaning head to pick up small debris. An example of this variation is found in the "VAC 'N' MOP" device available from Royal Appliance Manufacturing Co. of Cleveland, Ohio. These devices all suffer from being relatively rigid, which limits their ability to clean around contoured surfaces and into cracks and grout lines between tiles.

Still other proposed cleaning devices do away with the rigid cleaning head and replace it with a compressible open-cell foam cleaning head that is selectively covered by disposable cleaning cloths. One such device is described in U.S. patent application Ser. No. 10/806,310 (U.S. Publication No. 2004/0177863), which is also incorporated herein by reference. These devices appear to attempt to simulate the flexibility of conventional mop heads, but are expected to suffer from many of the same difficulties of conventional sponge cleaners. For example, if the open-cell foam becomes saturated with fluid, the device's weight can increase to the point where handling it becomes difficult, and it may inconveniently exude retained fluids when compressed. It is also believed that the foam underlying structure of this device may be subject to local compression at the point of contact with the cleaned surface, which may reduce the overall surface area of the device and cause excessive looseness of the covering cleaning cloth. Such foam structures also tend to flex laterally when a scrubbing motion is applied to them, and, if the amplitude of the motion is not great enough, this flexing effectively prevents the scrubbing motion from being transmitted to the surface being cleaned.

While these and other known hard surface cleaning systems may be somewhat effective, there still exists a need to provide a hard surface cleaning system that can provide better cleaning and disinfecting performance, while maintaining the user's expectations for convenience and ease of use.

SUMMARY OF THE INVENTION

In a first aspect, the present invention provides a flexible cleaning device having a handle having a first end and a second end, a malleable head at the first end of the handle, a cover selectively covering at least a portion of the malleable head, and a grip at the second end of the handle. A fluid reservoir is supported on the handle or the malleable head, a fluid deposition system is provided and adapted to selectively deposit fluid from the fluid reservoir onto a surface to be cleaned.

In another aspect, the present invention provides a flexible cleaning device having a handle having a first end and a second end, a rigid structure at the first end of the handle, a grip at the second end of the handle, and a malleable head attached to the rigid structure. The malleable head has a non-absorbent flexible structure adapted to conform to grout lines in a typical tiled surface. A cleaning cover is provided to selectively cover at least a portion of the malleable head.

In still another aspect, the present invention provides a flexible cleaning device having a handle having a first end and a second end, a rigid structure at the first end of the handle, a grip at the second end of the handle, a malleable head attached to the rigid structure, a cleaning cover selectively covering at least a portion of the malleable head, a fluid reservoir supported on the handle or the malleable head, a fluid deposition system adapted to selectively deposit fluid from the fluid reservoir onto a surface to be cleaned, an air inlet attached to the rigid structure or the handle, and an air passage adapted to connect the air inlet to a suction source.

DETAILED DESCRIPTION OF THE PREFERRED EMBODIMENTS

The present invention provides a cleaning device particularly adapted for hard surfaces, having a flexible head and a cleaning head cover. While the embodiments described herein and illustrated in the accompanying figures are depicted as self-contained cleaning devices, it will be understood that the cleaning head and/or fluid dispensing features of the device may be used with other types of cleaning device, such as conventional wet extractors, canister and upright vacuums, "shop" vacuums, and so on. These and other variations will be apparent to those of ordinary skill in the art in view of the present disclosure.

Figure 1:
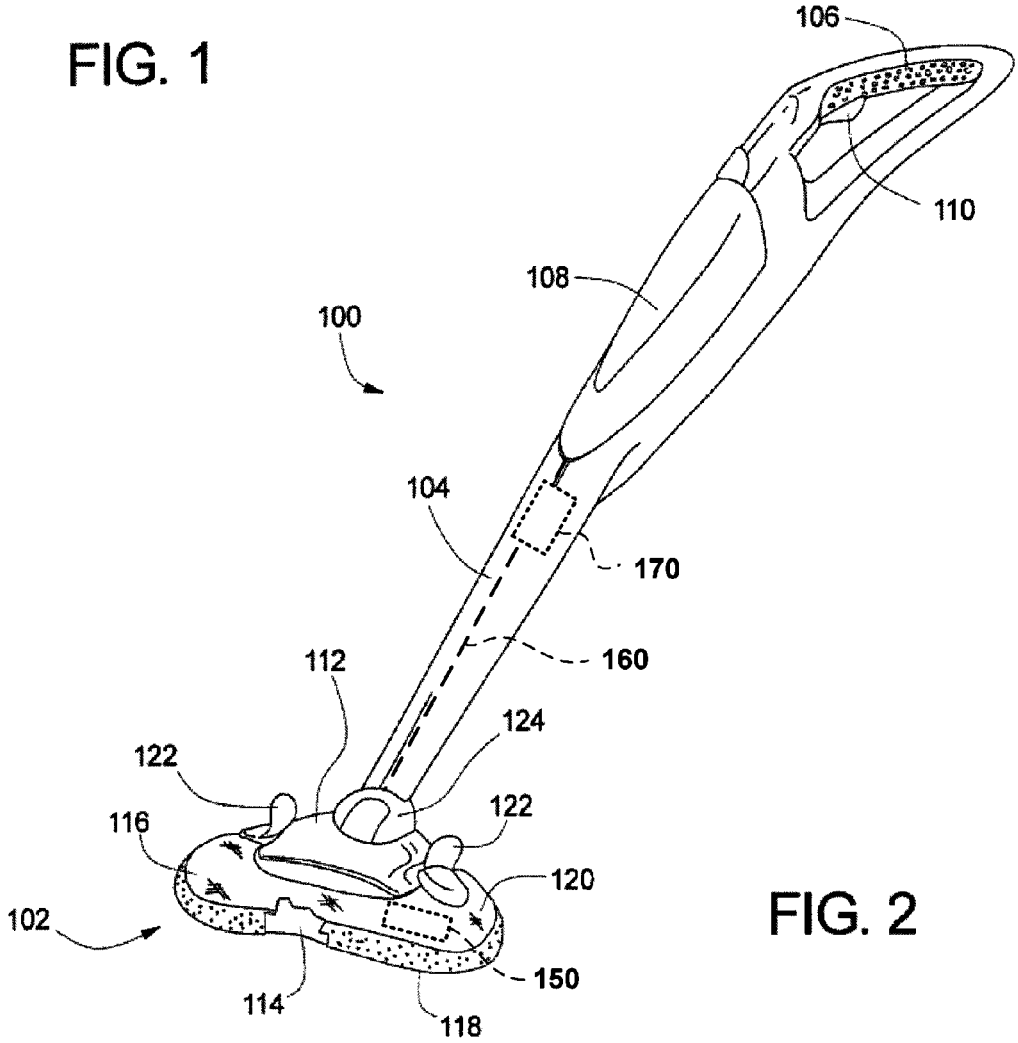
FIG. 1 is a partially cut away depiction of a first embodiment of the present invention.

Referring now to FIG. 1, a first embodiment of the invention is described. In this embodiment, the invention comprises a steam cleaner 100 having a cleaning head 102, a handle 104, a grip 106, a fluid reservoir 108, and a trigger 110 to control dispensing of the fluid from the fluid reservoir 108. Also included in the cleaner 100 are a fluid deposition system and an oscillator (not shown).

Figure 2:
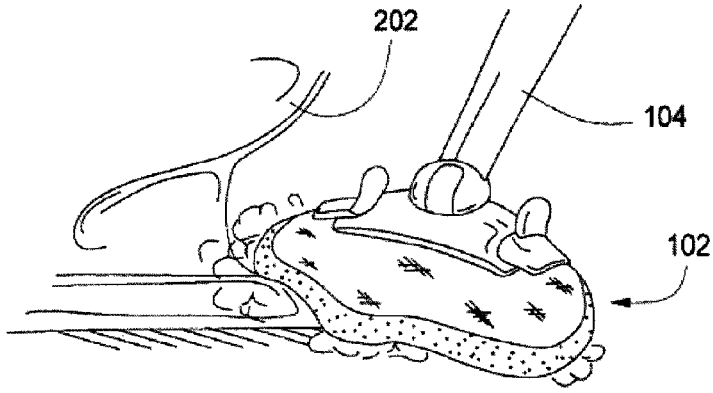
FIG. 2 is a fragmented depiction of the embodiment of FIG. 1, shown in operation.

The cleaning head 102 of this embodiment comprises a rigid backing structure 112 to which a malleable head 114 is attached. The malleable head 114 preferably comprises a gel-like substance that is relatively resistant to compression, but also readily conforms to fit the contours of surfaces being cleaned, as shown in FIG. 2, in which the device 100 is being used to clean around the back side of a conventional toilet 202. The use of a gel provides a number of advantages. For example, gel is relatively incompressible. As such, as one portion of the malleable head 114 compresses, another part of the head tends to expand, thereby maintaining a more consistent total surface area, which helps keep the cleaning cover 116 (described below) tight around the malleable head 114. The relative incompressibility of gel also allows it to more effectively transmit reciprocating movement or ultrasonic frequencies generated by the oscillator, if one is used. This transmission of oscillating movement is virtually impossible with a soft sponge-like head without resorting to dramatically increasing the amplitude of the head's movement. Using a fluid impervious gel as the malleable head also prevents the head from retaining fluids and re-depositing them when pressure is applied to the head.

The malleable head may also comprise a fluid-impervious flexible bladder into which a gel or other substance is placed. Any suitable flexible material can be used to form the bladder, but it should be flexible enough to allow some movement of the malleable head and at least limited capability to conform to complex surfaces, such as grout lines in floor or wall tiles and around the bases of toilets, tubs and counters, but should not be so flexible that the head does not retain its desired shape or can not transmit typical forces applied by the user during cleaning. If the bladder is made of a relatively thick, soft material, it may be formed to resist large deformations, but conform to cracks and grout lines. Such benefits may also be provided by forming the bladder with a relatively rigid inner layer, and a softer outer layer. Similarly, any suitable filler material can be used to fill the bladder. Again, the stiffness of the filler should be selected to provide conformability, but not so soft that it does not transmit cleaning forces or fails to retain its desired shape. Of course, the bladder and the filler work together, and therefore the individual properties of the bladder and its contents effect the overall properties of the device, and should be selected together to obtain the desired overall result. In an exemplary embodiment, the bladder comprises silicone gel, and the filler comprises granules, beads, pellets or another composition of loose media. Such media can comprise inert plastic (e.g., polyethylene), metal, glass (e.g., sand or glass beads) or other substances or mixtures of substances that would not decompose in the presence of moisture.

While a gel or loose media is preferred as the filler, other substances may be selected to cooperate with an appropriate bladder to obtain similar results. For example, a fluid impervious bladder may be used to encapsulate a block (or blocks) of foam (open- or closed-cell) to obtain a desirable embodiment of the invention. In this example, any disadvantage of using a locally-compressible foam is offset by using a liquid impervious bladder, which prevents fluid from being retained in the foam and inconveniently released onto the surface being cleaned when the foam is compressed. In another embodiment, the bladder may be molded into the desired shape and filled with beads, sand, or other loose media that help the bladder retain its shape, yet conform the bladder to the surface being cleaned. In still another embodiment, the bladder may simply be filled with compressed air or other gas, or even uncompressed air if the bladder itself has sufficient rigidity.

It is also envisioned that the cleaning cover 116 may act as the bladder for the malleable head 114. In such an embodiment, the cleaning cover 116 may comprise an absorbent material or an absorbent material having an impervious backing layer, that is formed with a pocket for receiving a gel pad that is captured between the cleaning cover 116 and the rigid backing structure 112 of the cleaning head 102.

It may also be desirable to provide the ability to selectively increase or decrease the stiffness of the malleable head 114. The stiffness can be readily increased or decreased by controlling the pressure of the gel within the bladder. As the pressure increases (such as by decreasing the volume within the bladder or increasing the amount of gel in the bladder), the stiffness increases. In one embodiment, the cleaning head 102 may be provided with an adjustable mechanical device that applies pressure to a portion of the malleable head 114 to reduce its volume to thereby stiffen the head. For example, the rigid backing structure 112 may have a strap that encircles a portion of the malleable head 114. When it is desired to increase the stiffness of the malleable head, this strap can be tightened to reduce the volume of the bladder, thereby increasing the pressure within the malleable head and increasing its resistance to deformation. As another example, an external reservoir of gel (or fluid or gas) may be provided in fluid communication with the contents of the malleable head 114. When it is desired to stiffen the head, contents of the external reservoir are forced into the malleable head to increase the pressure therein. In such an embodiment, the external reservoir could comprise a simple cylinder and piston arrangement in which the piston is pressed into the cylinder to force gel out of the cylinder and into bladder of the malleable head 114. Other arrangements will become apparent, without undue experimentation, to those of ordinary skill in the art upon further consideration and practice of the present invention.

A cleaning cover 116 is selectively attachable to wrap around the malleable head 114, and comprises any suitable material for scrubbing and cleaning hard surfaces. The cleaning cover 116 may also be impregnated with cleaning or floor treating chemicals or other useful substances. The cleaning cover 116 may be disposable, but preferably is a washable and reusable porous and/or absorbent material, such as cotton or synthetic cloth or nonwoven sheet. The cleaning cover 116 may also have mop-like yarns on its surface. Recognizing that some cleaning cover constructions may be better suited for cleaning particular surfaces than others, one embodiment of the invention may include multiple different types of cleaning cover 116 that are provided with, or available for, the device.

In the embodiment of FIG. 1, the cleaning cover 116 comprises a lower cleaning surface 118 and a stretchable upper trim 120. The cleaning cover 116 may thus be held in place by a friction connection created by the elastic contraction of the upper trim 120. As used herein, a friction connection is any connection that uses friction generated by surface contact or adhesion (rather than positive mechanical engagement) to hold two or more parts together. The cleaning cover 116 or the cleaning head 102 may also include a pair of tabs 122. These tabs 122 may simply comprise graspable extensions that are attached to the upper trim 120 and used to stretch the upper trim 120 over the cleaning head 102. The tabs 122 may instead be spring-loaded clips or hooks that lock into respective structures on the rigid backing structure 112 to provide a positive retention system for the cleaning cover 116. In an embodiment in which the tabs 122 lock into place, it is not strictly necessary for the upper trim 120 to be elasticized. The tabs 122 may also comprise clamps that are located on the rigid backing structure 112 of the cleaning head 102, rather than the upper trim 120 of the cleaning cover 116, and that are adapted to pinch down on, grasp or hook onto the upper trim 120 to hold it in place. Other mechanical connectors may also be used, as will be appreciated by those of ordinary skill in the art. For purposes of this disclosure, a mechanical connector includes any cooperating set of devices or structures that positively engage to hold the cleaning cover in place. Such positive engagement requires the mechanism to be released, forced open or broken to disengage the connected parts.

The handle 104 is attached to the cleaning head 102, and extends upwards to a grip 106. The handle 104 is preferably attached to the cleaning head 102 by a pivot 124, which may be a universal joint-type linkage that allows the operator to steer the cleaning head (i.e., rotate it in the plane of the surface upon which it rests) by twisting the handle 104 about its long axis. Such multi-directional swivel joints are known in the art. The grip 106 preferably is ergonomically-shaped, and may comprise a relatively soft or compliant insert that is overmolded into the handle 104 housing. The grip 106 may also comprise a painted-on, sprayed, screen printed or otherwise applied surface treatment of soft or tactile material to give the impression and feel of an overmolded grip.

The fluid reservoir 108 comprises any suitable fluid container, such as a commercially available plastic bottle or a custom-molded container. The fluid reservoir 108 is mounted in a recess in the handle 104 (or on the cleaning head 102) by one or more snap fittings, latches, camming surfaces, friction fit, or other retaining devices. Operative fluid communication between the fluid reservoir 108 and the steam cleaner 100 is provided by a dry-break fitting system in which the fluid supply has a valve that opens when it is properly seated in the handle 104. Such fittings are known and in widespread use in the art, and an example of such a system is described in U.S. Pat. No. 5,887,313, which is incorporated herein by reference. The fluid reservoir 108 may be provided having the appropriate cleaning solution contained therein, and/or may be refillable by the user. The fluid reservoir 108 may also comprise multiple separate or conjoined fluid containers, each intended to contain a different fluid therein. For example, a main container may be provided to supply water for regular steam cleaning, and a supplemental container may be provided to supply detergent that is used in lieu of or in addition to the water for conventional detergent-assisted cleaning at lower temperatures.

The fluid deposition system 160 comprises a system of fluid conduits that routes fluid from the fluid reservoir 108 to the cleaning head 102 (or to a position adjacent the cleaning head 102) for deposition on the surface to be cleaned. Fluid movement may be accomplished by gravity feed or a fluid pump. The trigger 110 controls, either directly or by a linkage, a fluid valve or pump motor to selectively control the fluid flow. While the device may operate with unheated or heated fluid, it is preferred to operate with steam, and thus the fluid deposition system preferably also includes a heater/steam generator 170 to heat the fluid to steam before it is deposited. Such steam generators are known in the art. The trigger 110 may be supplemented with other controls, such as a temperature control or a fluid mixture control to adjust the proportions of the cleaning fluids (when multiple fluids are used). A person of ordinary skill in the art will be able to construct an appropriate fluid deposition system based on the disclosure herein.

In order to improve cleaning performance, an oscillator 150 may optionally be provided, preferably in the cleaning head 102 itself, to vibrate the cleaning head 102. The oscillator may comprise any mechanism that vibrates the cleaning head 102, such as an electric motor with an offset driven weight or an ultrasonic wave generator. The oscillator may be operated when the trigger 110 is pulled, or may be controlled separately. It is also envisioned that the oscillator can be activated upon a partial pull of the trigger 110, with the fluid deposition system and oscillator both being activated upon a full pull of the trigger 110. This features allows scrubbing even when no fluid or steam is being deposited. Of course, other control variations are possible.

Figure 3:
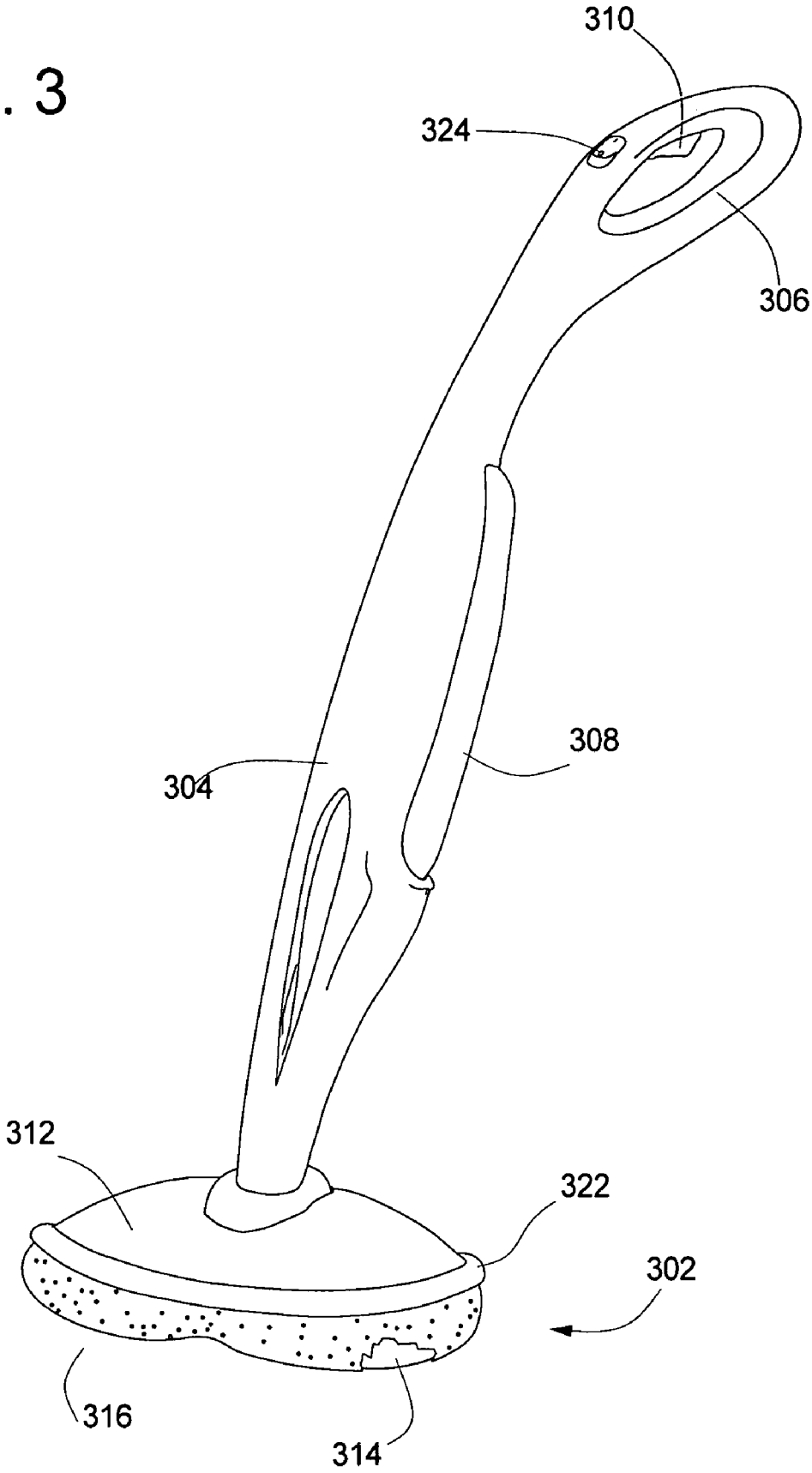
FIG. 3 is a partially cut away depiction of a second embodiment of the present invention.

A second embodiment of the invention is shown in FIG. 3. In this embodiment, the steam cleaner 300 also comprises a cleaning head 302 having a rigid backing structure 312 to which a malleable head 314 is attached. A handle 304 is pivotally attached to the cleaning head 302, and extends to a grip 306 having a trigger 310 or other controls thereon. In this embodiment, the fluid supply 308 is provided on the back side of the handle 304. A fluid deposition system and oscillator may also be provided, such as described before. This embodiment also has a cleaning cover 316, but in this case it is attached to the cleaning head 302 by a resilient band 322 (such as a band formed of strands or a single strand of rubber, latex, or other elastic or resilient substances). The resilient band 322 may be integral with the cleaning cover 316, provided separately, or provided as an attachment to the rigid backing structure 312 of the cleaning head 302 that is pushed down into place to grip the cleaning cover 316. The embodiment of FIG. 3 also has a main power switch 324 for enabling and disabling all functions of the device at once.

In a variation of this or other embodiments of the invention, the malleable head 314 may be removable from the rigid backing structure 312 of the cleaning head 302. This may be desirable for cleaning the malleable head 314 separately from the cleaning cover 312, replacing the malleable head 314 should it become damaged or worn out, or for other useful purposes. Such a device may also be equipped to operate without the malleable head 314 in place.

In still another variation of this or other embodiments, the malleable head 314 and cleaning cover 316 are provided as a unit that is removable from the rigid backing structure 312 of the cleaning head 302. In such an embodiment, the cleaning cover 316 may be permanently attached to the malleable head 314, and the two may be reusable or intended for a single or limited use before being replaced. In such an embodiment, the cover/head combination may be attached to the rigid backing structure 312 (or directly to the handle 304, if no backing structure 312 is desired), by any of the attachment means described herein or within the known art. For example the cover/head combination may be attached by having the aforementioned elasticized upper trim, clips or tabs, or by a hook-and-loop (e.g., VELCRO) fastening surface that mates with a corresponding surface on the backing structure 312.

Figure 4:
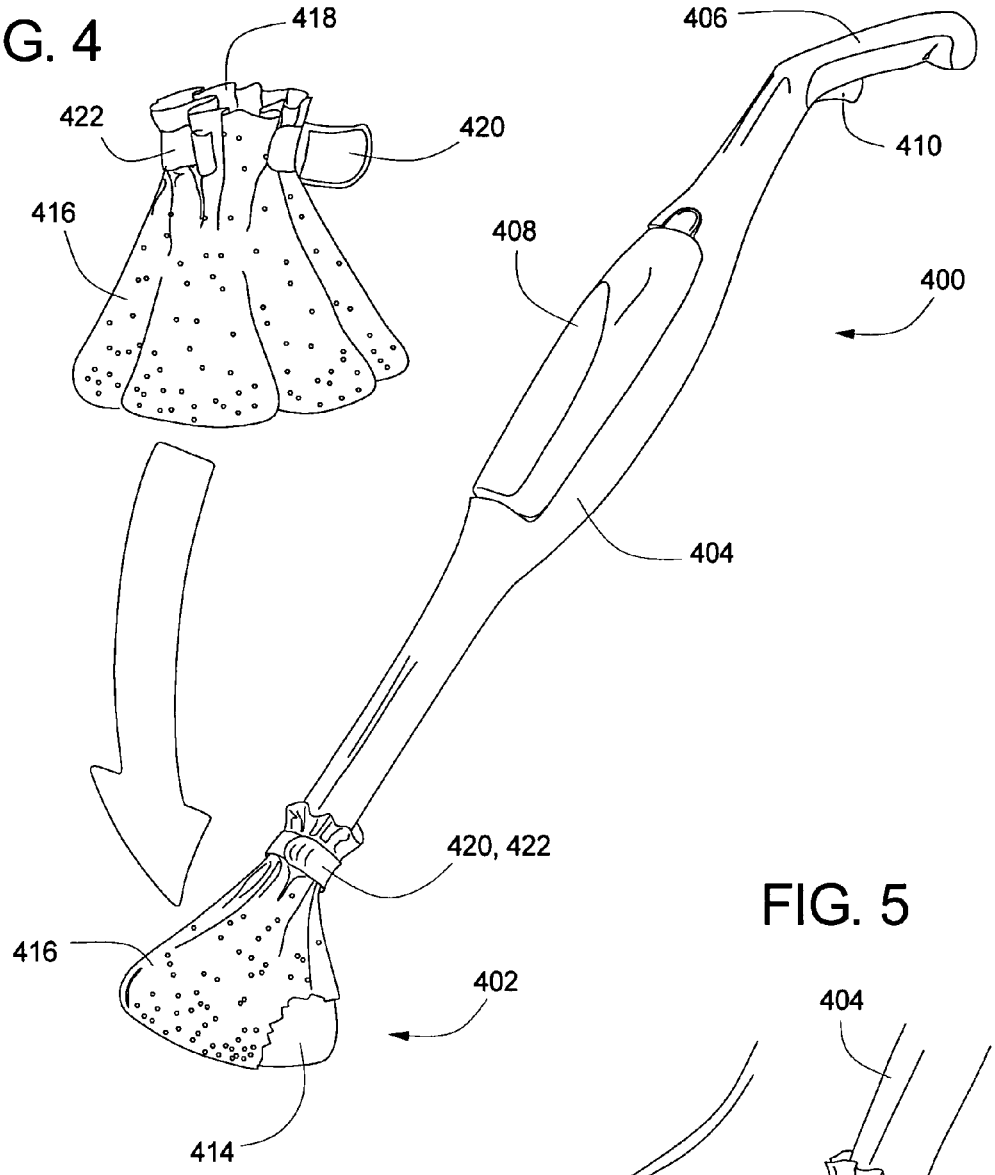
FIG. 4 is a partially cut away depiction of a third embodiment of the present invention.
Figure 5:
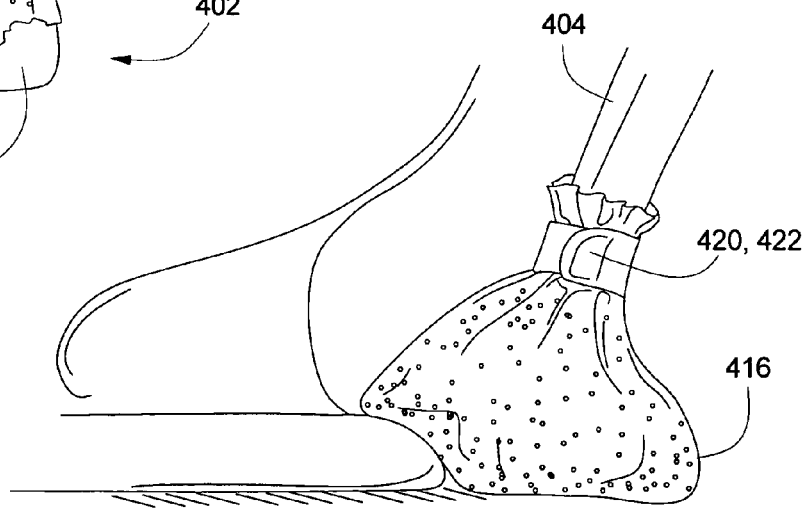
FIG. 5 is a fragmented depiction of the embodiment of FIG. 4, shown in operation.

Turning now to FIG. 4, a third embodiment of a steam cleaner 400 of the present invention is shown. In this embodiment, the steam cleaner 400 comprises the handle 404, grip 406, fluid supply 408 and trigger 410 components as described before. This embodiment differs from the previous embodiments, however, in that the cleaning head 402 does not have a significant rigid backing structure. Instead, the malleable head 414 is attached directly to the handle 404 by a non-pivoting connection. While this connection may exclude mechanical pivots, it may still be somewhat flexible. Another difference between this embodiment and those described previously herein is that the cleaning cover 416 comprises a bag-like structure. The cleaning cover 416 has an open end 418 that fits over the malleable head 414, and a fastening system 420, 422 that holds the cleaning cover 416 in place around the base of the malleable head 414, as shown in FIG. 4. The embodiment of FIG. 4 is shown in operation in FIG. 5.

The fastening system 420, 422 may comprise a hook-and-loop fastener (e.g., VELCRO fastener), a snap fastener, an adhesive fastener, or any other type of releasable fastening system. It is preferred, in this embodiment, for the interlocking components 420, 422 of the fastening system to both be attached to the cleaning cover 416, but one of the components may instead be positioned on the handle 404 or cleaning head 402. For example, the cleaning cover 416 may comprise loops, and the handle 404 may have hooks onto which the loops are attached to hold the cleaning cover 416 in place.

Figure 6:
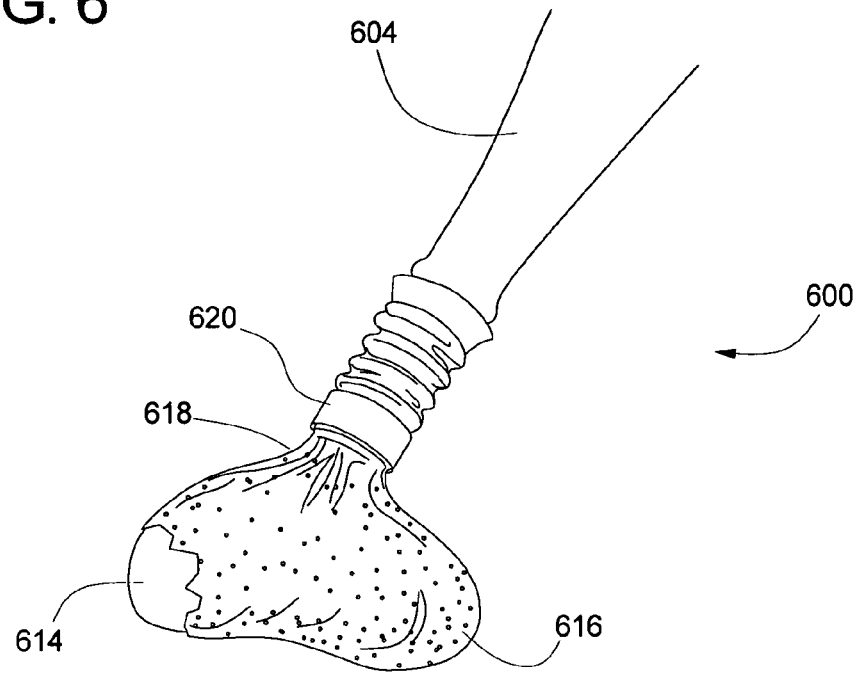
FIG. 6 is a fragmented depiction of a fourth embodiment of the present invention

Yet another embodiment of the invention is shown as the steam cleaner 600 of FIG. 6. This embodiment comprises the handle 604 and cleaning head 602 (shown as a malleable head 614), and other features as described previously herein, and is similar to the embodiment of FIG. 4. In this embodiment, the cleaning cover 616 comprises a sack-like structure that is wrapped over the malleable head 614, as in the embodiment of FIG. 4, but in this case the cleaning cover 616 is not provided with its own fastening system. Instead, the cleaning cover 616 is attached by gathering its open end around the narrow upper end 618 of the cleaning head 602 and moving a sliding ring clip 620 down in place to hold the open end, as shown in FIG. 7.

Figure 7:
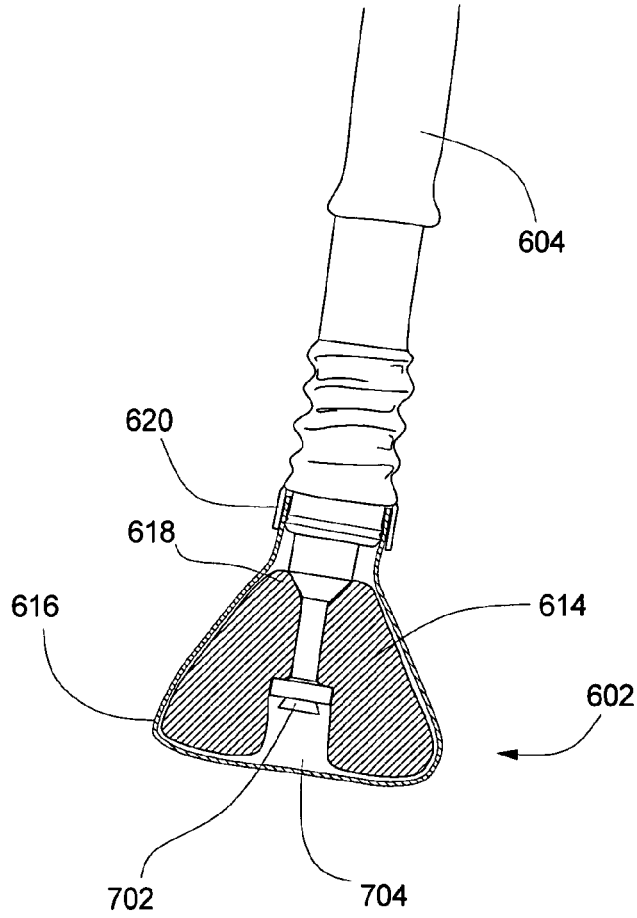
FIG. 7 is a partially cut away view of the embodiment of FIG. 6.

FIG. 7 is a cross-section view of the steam cleaner 600 of FIG. 6, in which the fluid deposition system is shown in more detail. Here it can be seen that the fluid deposition system terminates at a spray nozzle 702 located in a recessed steam pocket 704 in the malleable head 614. Steam is ejected from the spray nozzle 702 into the steam pocket 704, where it passes through the porous cleaning cover 616, and is forced into contact with the surface being cleaned. While this arrangement is preferred and expected to provide effective cleaning and containment of the steam and condensing fluid, other arrangements may be used. For example, the spray nozzle 702 may be located outside the malleable head 614, or even on the handle 604, and directed to project the fluid or steam in front of or behind the malleable head 614.

FIG. 7 also shows the manner in which the malleable head 614 is attached to the handle 604. Specifically, the malleable head is retained on the handle 604 by the spray nozzle 702, which passes through an opening through the malleable head 614 and is flanged at its end to hold the malleable head 614 in place. Of course, any other manner of attaching the malleable head 614 may be suitable for use with the present invention.

Figure 8A:
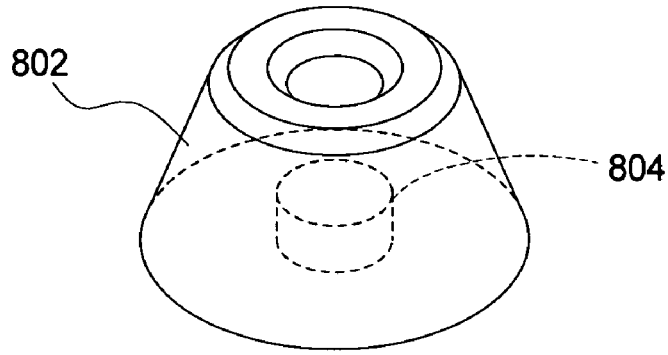
FIGS. 8A-C are isometric views of three embodiments of malleable heads of the present invention.
Figure 8B:
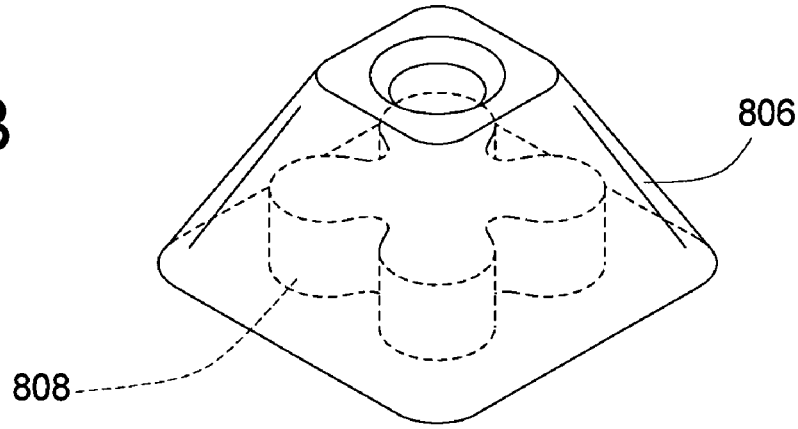
Figure 8C:
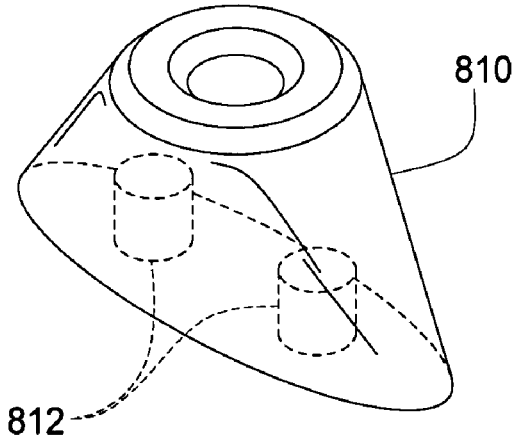

The malleable head of the present invention can take any number of useful shapes, and the invention may be provided as a kit having multiple malleable heads, each having a shape suited to a different type of cleaning job. Referring now to FIGS. 8A-C, various exemplary shapes of malleable heads are shown. In FIG. 8A, the malleable head 802 comprises a conical shape having a tapered circular profile for general cleaning purposes. This embodiment has a single, circular steam pocket 804 in its base where the steam nozzle is located. The malleable head 806 of FIG. 8B comprises a pyramid shape having a single steam pocket 808 that is shaped to direct steam from a single central nozzle to the corners of the base. This cleaning head 806 may be better suited for cleaning into corners, and may be triangular to help fit into tight corners. The cleaning head 810 of FIG. 8D comprises a tapered elliptical shape for cleaning in tight corners and narrow spaces. This cleaning head 810 has two separate steam pockets 812, each of which receives steam from a corresponding nozzle.

As noted previously herein, the present invention may be adapted for use with wet extractors, upright or canister vacuums, and other suction cleaning implements. A cleaning device of the present invention may be integrated into such devices in any number of ways, as will be appreciated by those of ordinary skill in the art in view of the foregoing disclosure. Two examples of such applications are shown in FIGS. 9 and 10.

Figure 9:
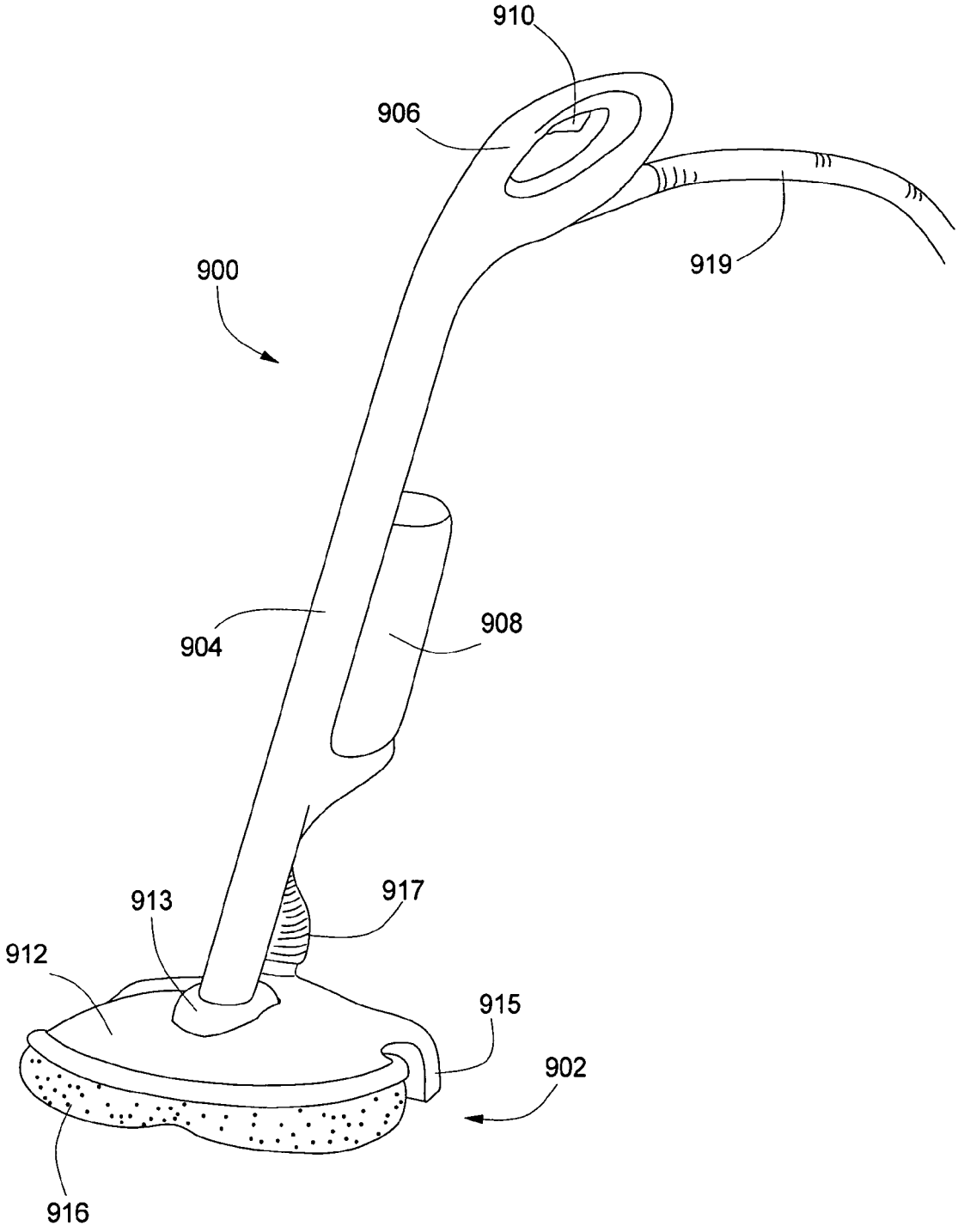
FIG. 9 is a further embodiment of the present invention shown in use with a suction cleaner.

FIG. 9 depicts an embodiment similar to that shown in FIG. 3, but which is further adapted to be attached to a suction source to provide additional cleaning functionality. In this embodiment, the steam cleaner 900 comprises a cleaning head 902 having a rigid backing structure 912 to which a malleable head is attached. A hollow handle 904 is pivotally attached to the cleaning head 902 by a flexible joint 913, and extends to a grip 906 having a trigger 910 or other controls thereon. A fluid or steam supply 908 is provided on the hollow handle 904, and a hose and valve (not shown) conveys fluid from the supply 908 to the cleaning head 902 upon activation of the trigger 910. A cleaning cover 916 is also provided, as described in previous embodiments.

In this embodiment, the backing structure 912 includes an air inlet 915 located along its back edge (or alternatively, its front and/or side edges). The air inlet 915 is positioned near the floor, and may have downwardly-extending flexible brushes or squeegees (not shown) that are located at or near the floor during use to help direct suction air, water and debris into the inlet 915. The air inlet 915 may be rigidly attached to the rigid backing structure 912, as shown, or it may be flexible attached thereto by one or more pivots, as known in the art, to allow it to move on or above the floor separately from the malleable head. The air inlet 915 is connected to the hollow handle 904 by a hose 917. The hollow handle 904 provides an air passage from the air inlet 915 to the end of the hollow handle 904 at grip 906. The hollow handle 904 ends at the grip 906, which is adapted to connect to a conventional vacuum cleaner hose 919, which may extend and connect to an upright vacuum, canister vacuum, central vacuum, or the like, to provide a vacuum at the air inlet 915 that draws in debris and fluid not retained by the cleaning cover 916.

Figure 10:
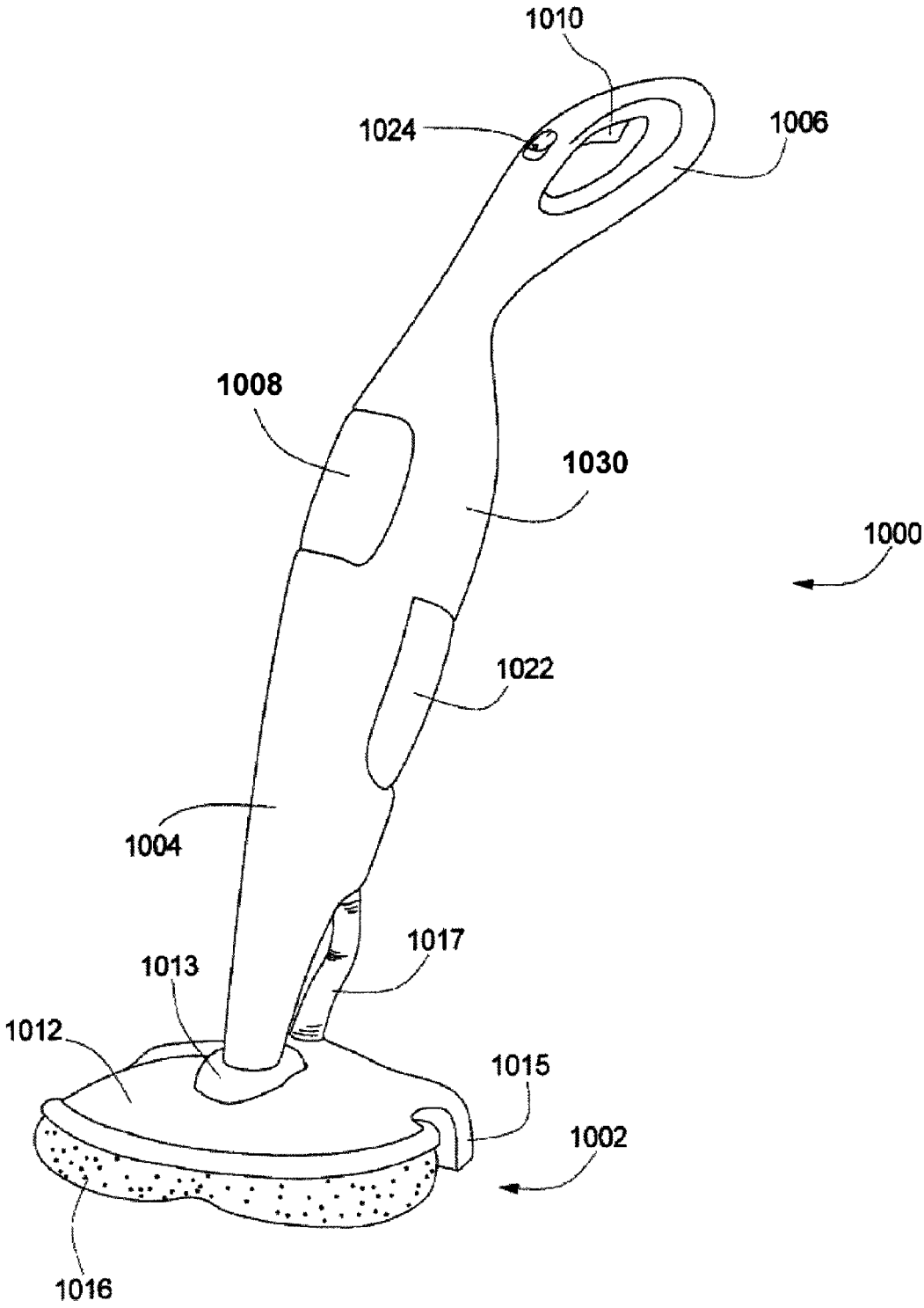
FIG. 10 is a further embodiment of the present invention shown with integrated suction cleaner features.

FIG. 10 depicts another embodiment similar to that shown in FIG. 9, but with an integrated suction source and dirt receptacle to recover dirt and fluid. The cleaner 1000 of this embodiment comprises a cleaning head 1002 having a rigid backing structure 1012 to which a malleable head is attached. A handle 1004 is pivotally attached to the cleaning head 1002 by a flexible joint 1013, and extends at its upper end to a grip 1006 having a trigger 1010 and a main power switch 1024. A fluid supply 1008 is provided on the handle 1004, and a hose and valve (not shown) conveys fluid from the supply 1008 to the cleaning head 1002 upon activation of the trigger 1010. A cleaning cover 1016 is also provided, as described in previous embodiments. Like the embodiment of FIG. 9, the backing structure 1012 includes an air inlet 1015 located along its back or other edges. In this or other embodiments, the inlet 1015 may alternatively be located within the perimeter of the malleable head and cleaning cover 1016, in which case the cleaning cover 1016 may have an opening that fits over the inlet 1015 to allow air, dirt and fluid to pass freely into the inlet 1015. The air inlet 1015 is positioned near the floor, and may have downwardly-extending flexible brushes or squeegees (not shown) that seal against the floor during use. The inlet 1015 may also include a rotating brushroll that is powered by an air turbine, a separate motor, or by other means as known in the art.

The cleaner 1000 also includes a vacuum fan and its associated fan motor (not shown), which are contained within a fan/motor housing 1030 located along the cleaner handle 1004. Also provided is a dirt and fluid recovery tank 1022. The dirt and fluid recovery tank 1022 may be located in an air passage between the air inlet and the suction source. For example, an inlet into the recovery tank 1022 is fluidly connected to the air inlet 1015 by a flexible hose 1017, and an outlet from the recovery tank 1022 is fluidly connected to the fan, as known in the art, to thereby create a dirt and fluid recovery system. Any suitable fan or recovery tank configuration may be used with the present invention. In operation, the main power switch 1024 or a separate switch is operated to turn on the fan, and draw dirt and fluid into the recovery tank 1022.

While the embodiments described herein are preferred, these are not intended to limit the scope of the invention. Indeed, many variations on the embodiments herein will be apparent to those of ordinary skill in the art, and such variations are within the scope of the present invention. For example, while the present invention is shown as a stand-alone device, it may be instead be adapted for use with other cleaning devices. Also, variations in the shape and composition of the malleable head and other parts are also within the scope of the invention. Further, while the embodiments all show the device being used with a fluid deposition system, this may be omitted or provided separately (such as by providing a separate spray bottle), and the device can use either dry cleaning covers, or pre-moistened cleaning covers. Other variations will also be readily apparent to those of ordinary skill in the art in light of the teachings provided herein.

We claim:

1. A flexible cleaning device comprising:

a handle having a first end and a second end;

a malleable head at the first end of the handle;

a cover selectively covering at least a portion of the malleable head;

a grip at the second end of the handle;

a fluid reservoir; and a fluid deposition system adapted to selectively deposit fluid from the fluid reservoir onto a surface to be cleaned;

wherein the malleable head comprises a flexible bladder containing gel or loose media.

2. The flexible cleaning device of claim 1, wherein the fluid deposition system comprises a heater or steam generator.

3. The flexible cleaning device of claim 1, further comprising an oscillator adapted to impart oscillations to the malleable head.

4. The flexible cleaning device of claim 1, wherein the cover comprises a cleaning portion positionable on a lower surface of the malleable head, and a flexible upper portion extending from the cleaning portion and adapted to elastically contract against an upper surface of the malleable head to thereby retain the cover on the malleable head.

5. The flexible cleaning device of claim 1, wherein the malleable head is adapted to conform to grout lines in a typical tiled surface.

6. A flexible cleaning device comprising:

a handle having a first end and a second end;

a rigid structure at the first end of the handle;

a grip at the second end of the handle;

a malleable head attached to the rigid structure, the malleable head comprising a non-absorbent or fluid-impervious flexible bladder adapted to conform to grout lines in a typical tiled surface; and a cleaning cover selectively covering at least a portion of the malleable head.

7. The flexible cleaning device of claim 6, wherein the rigid structure is attached to the handle by a pivotable joint.

8. The flexible cleaning device of claim 6, wherein the flexible bladder is filled with gel, loose media, or flexible material.

9. The flexible cleaning device of claim 6, further comprising fluid reservoir, and fluid deposition system adapted to selectively deposit fluid from the fluid reservoir onto a surface to be cleaned.

10. The flexible cleaning device of claim 6, further comprising an oscillator adapted to impart oscillations to the malleable head.

11. The flexible cleaning device of claim 6, further comprising:

an air inlet; and an air passage adapted to connect the air inlet to a suction source.

12. The flexible cleaning device of claim 11, wherein the air passage comprises a hollow portion of the handle.

13. The flexible cleaning device of claim 11, further comprising:

a suction source; and a dirt receptacle;

wherein the dirt receptacle is fluidly connected to the air inlet and the suction source and adapted to receive and retain debris drawn into the air inlet by the suction source.

14. A flexible cleaning device comprising:

a handle having a first end and a second end;

a rigid structure at the first end of the handle;

a grip at the second end of the handle;

a malleable head attached to the rigid structure and comprising a non-absorbent or fluid-impervious flexible bladder;

a cleaning cover selectively covering at least a portion of the malleable head;

a fluid reservoir; a fluid deposition system adapted to selectively deposit fluid from the fluid reservoir onto a surface to be cleaned;

an air inlet;

a suction source; and an air passage adapted to connect the air inlet to the suction source.

15. The flexible cleaning device of claim 14, wherein the malleable head is a structure adapted to conform to typical irregularities in a tile surface.

16. The flexible cleaning device of claim 14, wherein the malleable head comprises a non-absorbent outer surface.

17. The flexible cleaning device of claim 14, further comprising an oscillator adapted to impart oscillations to the malleable head.

18. The flexible cleaning device of claim 14, wherein the air passage comprises a hollow portion of the handle.

19. The flexible cleaning device of claim 14, further comprising:

a suction source; and a dirt receptacle;

wherein the dirt receptacle is fluidly connected to the air inlet and the suction source and adapted to receive and retain debris drawn into the air inlet by the suction source.

20. A flexible cleaning device comprising:

a handle having a first end and a second end;

a malleable head at the first end of the handle;

a cover selectively covering at least a portion of the malleable head;

a grip at the second end of the handle;

a fluid reservoir; and a fluid deposition system adapted to selectively deposit fluid from the fluid reservoir onto a surface to be cleaned;

wherein the malleable head comprises a flexible bladder that is fluid-impervious or non-absorbent.

21. The flexible cleaning device of claim 20, wherein the malleable head comprises a flexible bladder containing gel, loose media, or flexible material.

22. The flexible cleaning device of claim 20, comprising an oscillator adapted to impart oscillations to the malleable head.

23. The flexible cleaning device of claim 20, wherein the malleable head is adapted to conform to grout lines in a typical tiled surface.

* * * * *